United States Patent [19]

Cullen et al.

[11] 4,003,456

[45] Jan. 18, 1977

[54] ELECTRICAL CABLE REELING APPARATUS

[75] Inventors: Roy H. Cullen; Joshua M. Jackson; Terry V. Jones, all of Houston, Tex.

[73] Assignee: General Electric Company, by said Joshua M. Jackson and said Terry V. Jones

[22] Filed: Oct. 9, 1975

[21] Appl. No.: 621,111

[52] U.S. Cl. ..... 191/12.4

[51] Int. Cl.[2] ..... H02G 11/02

[58] Field of Search ..... 137/355.12, 355.16, 137/355.17; 191/12.2 R, 12.2 A, 12.4; 242/77, 77.3

[56] References Cited

UNITED STATES PATENTS 2,348,966 5/1944 Dow et al. ..... 191/12.2 R X

*Primary Examiner*—Stephen G. Kunin

*Attorney, Agent, or Firm*—Pravel, Wilson & Gambrell

[57] ABSTRACT

A reeling apparatus for supplying, receiving and storing a section of electrical cable having substantially rigid terminal connectors at the ends of the section, wherein apparatus are provided for releasably securing at least one of the electrical cable terminal connectors with a rotatable reel of the apparatus for rotation therewith as the electrical cable is wound on and unwound from the reel, and for releasing the releasably secured terminal connector from the reel upon the unwinding of the cable therefrom to thereby release the entire section of the cable from the reel.

9 Claims, 8 Drawing Figures

ELECTRICAL CABLE REELING APPARATUS

BACKGROUND OF THE INVENTION

This invention relates to reeling apparatus for handling fixed lengths or sections of electrical cable.

There are reeling or spooling apparatus that have been described in the art for handling many types of flexible tubular members, such as electrical cable, flexible well tubing, flexible hose, and the like, so name a few. However, a problem is presented in the handling of electrical cable sections having substantially rigid connectors at the section ends, because the connectors of such cables interfere with the winding of the cable onto a drum of the reeling or spooling apparatus. Additionally, the substantially rigid terminal connectors may be subjected to excessive bending moments when wound on the drums of such apparatus which may cause damage thereto and to the electrical cable conductors. So far as is known, no one has previously provided a satisfactory reeling apparatus for storing and feeding an entire electrical cable section where the entire length of the electrical cable section, including the end connectors, is wound on and completely removed from the reel of the apparatus.

SUMMARY OF THE INVENTION

Accordingly, the present invention provides a new and improved electrical cable reeling apparatus for storing, receiving and feeding therefrom a complete section of an electrical cable having substantially rigid terminal connectors at the ends of each section which includes a rotatable reel provided with means for releasably securing at least one of the electrical cable terminal connectors for rotation therewith without interfering with the winding of the electrical cable on the reel and for releasing the terminal connector from the reel when the cable is unwound therefrom. The apparatus also includes means for transporting one end of the electrical cable to and from a remote location to facilitate the positioning and releasing of the releasably secured cable terminal connector relative to the reel.

BRIEF DESCRIPTION OF THE DRAWINGS

A preferred embodiment of the apparatus of this invention is shown in the drawings, wherein.

DESCRIPTION OF THE PREFERRED EMBODIMENT

Figure 1:
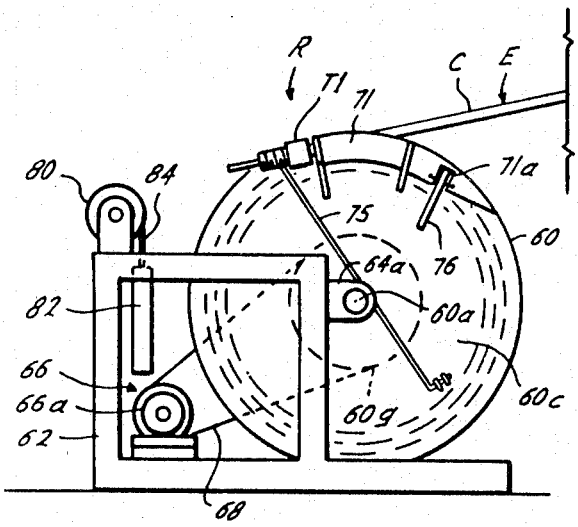
FIG. 1 is a side view of the apparatus having an electrical cable section wound on the reel illustrating the positioning of the cable terminal connector with the reel for rotation therewith.
Figure 2:
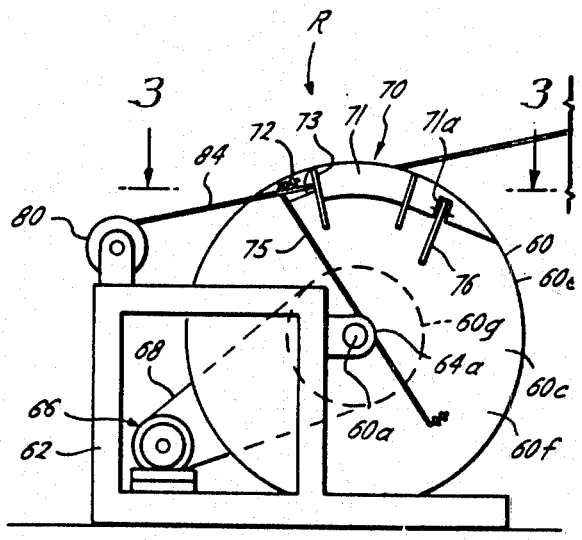
FIG. 2 is a view similar to FIG. 1 but illustrating the cable connector positioning and releasing means of the reel positioned for receiving the cable terminal connector for winding of the cable on the reel.

In the drawings, the letter E generally designates a fixed length of electrical cable which includes one or more electrical conductors formed into an insulated conductor section C having a male terminal connector T1 connected at one end of the section C and a similar female terminal connector (not shown) connected at the opposite end of the section C. The terminal connectors are usually substantially rigid and have diameters greater than the conductor section C diameter to facilitate the coupling of a plurality of cables E. The electrical cable E may be of any desired length and size. However, as will become more readily apparent from the following description, the apparatus of the present invention is particularly adapted to handle relatively long lengths of cable sections, e.g. 1,000 to 5,000 ft., which are constructed of a plurality of relatively large diameter conductors suitable for installation in a well bore for transporting power, telemetry signals and the like between the surface and a down-hole electrically powered drilling apparatus or other electrical equipment.

Referring now to the drawings, the electrical cable supply and storage reel apparatus, generally designated as R, of the present invention includes a reel 60 having an axial shaft 60*a* which is mounted for rotation on a support frame 62 by conventional means such as pillow blocks 64*a*, 64*b*. The main part of the reel 60 is of conventional construction having a cylindrical drum 60*b* and circular end walls 60*c*, 60*d* with diameters greater than the cylindrical drum 60*b* so as to retain the electrical cable E on the cylindrical drum 60*b* as it is helically wound and unwound with respect thereto. However, the supply reel 60 is further provided with a releasable means, generally designated 70, for positioning the electrical cable terminal connector T1 on the reel 60 for rotation therewith and for releasing the terminal connector T1 when the cable E is unwound therefrom. The releasable means 70 protects the terminal connector T1 and the cable conductor C from excessive bending moments during cable winding and unwinding and thereby prevents damage thereto.

As illustrated, the releasable means 70 is mounted with the reel side wall 60*c* substantially adjacent its circumferential edge 60*e* for positioning the cable terminal connector T1 for rotation with the reel 60 outwardly adjacent the circular end wall outer surface 60*f*. More particularly, the releasable means 70 includes an outwardly extending flange member 71 fixedly mounted with the end wall outer surface 60*f* and a gate member 72 pivotally mounted with the end wall 60*c*. Also included is a cable connector catch plate 73 perpendicularly mounted between the end wall outer surface 60*f* and the outwardly extending flange 71 having a groove 73*a* for receiving the cable E.

Figure 3:
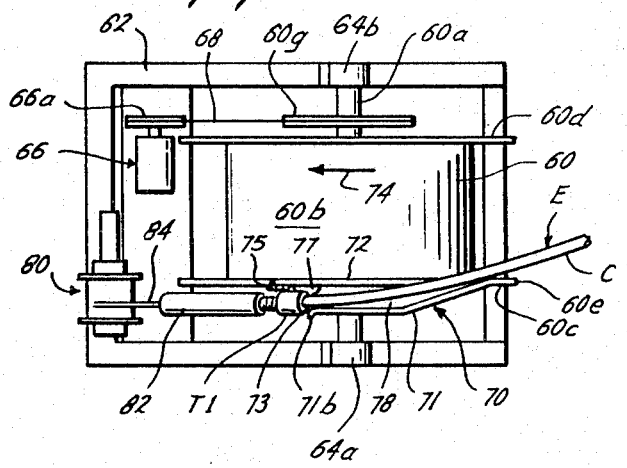
FIG. 3 is a plan view of the apparatus taken along line 3—3 of FIG. 2 shown in position for receiving the electrical cable terminal connector for cable winding.
Figure 3A:
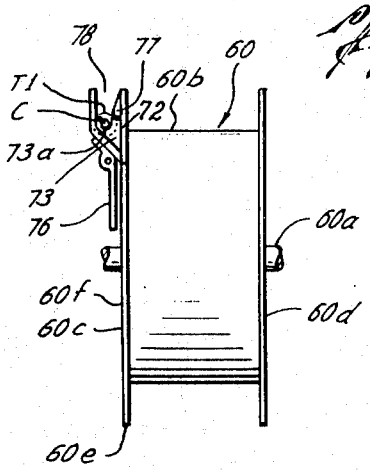
FIG. 3A is an elevation of the reel as illustrated in FIG. 3.

As illustrated in FIGS. 3 and 3A, the outwardly extending flange 71 and pivotal gate member 72 are mounted substantially adjacent to the side wall upper edge 60*e* and to each other forming a space 78 therebetween for receiving a portion of the electrical cable E upon rotation of the reel 60 in the direction shown by the arrow 74.

Figure 4:
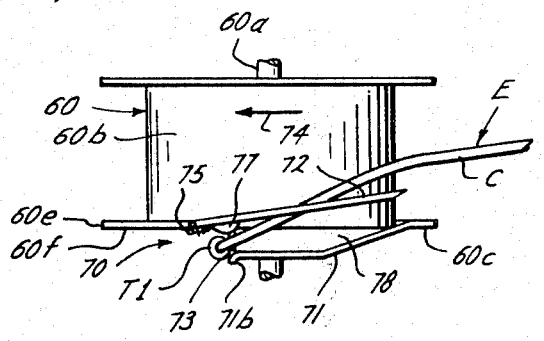
FIG. 4 is a plan view of the apparatus showing the positioning of the electrical cable and its terminal connector on the reel as the reel is rotated from the position illustrated in FIGS. 3 and 3A when the cable is being wound thereon.
Figure 4A:
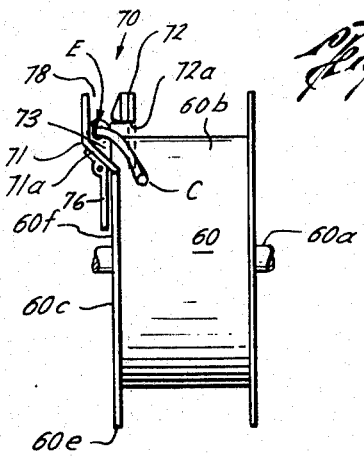
FIG. 4A is an elevation of the apparatus as shown in FIG. 4.

The pivotal gate member 72 is adapted for pivotal movement between a first position in substantial alignment with the circular end wall circumferential edge 60*e* and a second position inwardly thereof over the cylindrical reel drum 60*b* (FIGS. 4, 4A). Additionally, the pivotal gate member 72 has an arcuate-shaped lower edge 72*a* (FIG. 4A) which is spaced from the cylindrical reel drum 60*b* a sufficient distance to permit the passage of the electrical cable conductor portion C thereunder. The gate member 72 is forcibly held in the aforementioned first position in alignment with the end wall edge 60*e* by means of a spring element 75 mounted with the end wall outer surface 60*f* and the gate member 72.

Figure 5:
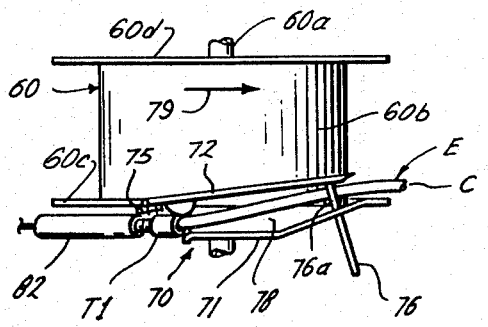
FIG. 5 is a plan view of the apparatus shown in position for releasing the electrical cable and its terminal connector therefrom when the cable is unwound.
Figure 5A:
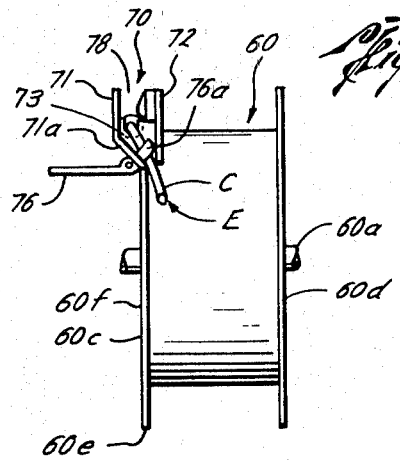
FIG. 5A is an elevation of the apparatus shown in FIG. 5.

Additionally, a trigger member 76 having a protrusion 76*a* is pivotally mounted on the flange 71 adjacent a flange opening 71*a* which is adapted to engage the gate member 72 and move it from the aforementioned first aligned position to the aforementioned second inward position for releasing the electrical cable E and its terminal connector T from the reel 60 during unwinding (FIGS. 5 and 5A).

Further, a connector guide member 77 is mounted with the pivotal gate member 72 and the outwardly extending flange 71 has a curved lip portion 71*b*, both positioned adjacent the connector catch plate member 73, to facilitate the positioning of the cable terminal connector T1 for engagement with the grooved catch plate 73.

The cable supply and storage assembly R of the invention also includes a means, generally designated 66, for controlling the rotation of the supply reel 60 thereby controlling the rate at which the electrical cable E is wound onto and unwound from the reel 60. The rotation rate control means 66 may include any conventional power and braking apparatus, such as hydraulic motor and brake assembly of conventional design, positioned on the frame 62 which is connected with the supply reel 60 such as by sprocket 66*a*, 60*g* and chain 68.

The supply reel assembly R is also provided with a winch assembly 80, preferably mounted with the frame 52 adjacent the reel end wall 60*c* for transporting one end of the electrical cable E between the cable reel assembly R and a remote location. The winch assembly 80 includes a swivel connector 82 mounted with the winch cable 84 and adapted for connected by threads or the like with the electrical cable terminal connector T1 for extending over the threads of the connector T1 for thereby protecting them as the connector is transported between the supply reel assembly R and the remote location, such as a well, for insertion and removal of the cable E into and from the well bore. Further, the mounting of the winch assembly 80 adjacent the supply reel end wall 60*c* permits the electrical cable E and its terminal connector T1 to be positioned adjacent the end wall outer surface 60*f* whereby it can be automatically positioned on the reel 60 by rotation of the supply reel 60 in the direction of the arrow 74 illustrated in FIG. 3 during cable winching and can be substantially automatically removed from the supply reel 60 by rotation in the direction of the arrow 79, as illustrated in FIG. 5.

As illustrated in FIGS. 3–5A, and beginning with FIGS. 3 and 3A, in the operation of the cable supply and reel assembly R, the electrical cable E may be received and wound on the cylindrical reel 60 by initially positioning the cable terminal connector T1 adjacent the end wall outer surface 60*f* in alignment for engagement with the connector catch plate 73 between the flange 71 and the gate 72. As mentioned hereinbefore, where the cable E is initially remotely located, such positioning and alignment may be facilitated by threadably connecting the protective connector 82 of the winch assembly 80 with the terminal connector T1 and winching the cable E to the aforementioned position adjacent the reel end wall outer surface 60*f*. Upon rotation of the reel 60 in the direction of the arrow 74, such as by activating the power and braking apparatus of the reel rotation control means 66 in a known manner, the terminal connector engages the grooved catch plate 73 with the cable conductor C being received in the groove 73*a*, the positioning of which is facilitated by the positioning member 77 and the flange lip portion 71*b*. When the terminal connector T1 engages the grooved catch plate 73, the protective connector 82 may be disconnected from the electrical terminal connector T1 whereby any tension on the electrical cable E is transferred therefrom to the catch plate 73. Upon further rotation of the reel 60 in the direction of the arrow 74 (FIG. 3) the cable conductor section C is moved downwardly in the receiving space 78 between the outwardly extending flange 71 and the gate member 72 until it comes into engagement therewith. Further rotation forces the cable conductor section C downwardly between the gate member 72 and the flange 71 forcing the gate member to move from the aforementioned first position in alignment with the end wall edge 60*e* (FIGS. 3 and 3A) towards the second inward position until the cable conductor section C engages the reel cylindrical drum 60*b* as illustrated in FIGS. 4 and 4A. Upon such engagement, the cable conductor section C passes under the gate member lower edge 72*a* thereby permitting the gate member 72 to forcibly move back to the first aligned position under spring pressure. Further continued rotation of the reel 60 in the direction of the arrow 74 causes the electrical cable E to the helically wound on the reel cylindrical drum 60*b* between the end walls 60*c* and 60*d* with the cable terminal connector T1 being positioned outwardly therefrom adjacent the end wall outer surface 60*f*. It will be readily apparent that such positioning of the terminal connector T1 outwardly from the reel drum 60*b* prevents it from interfering with the orderly helical winding of the electrical cable conductor section C thereon. Additionally, such positioning protects the terminal connector T1 and the cable conductor C at an interfere therewith from excessive bending moments which in all probability would occur if the terminal connector T1 was positioned on the reel drum 60*b* which could cause damage thereto. Further, the positioning of the terminal connector T1 outwardly of the drum 60*b* permits access thereto so that the electrical continuity of the electrical cable E may be tested while helically wound and stored on the reel 60.

The electrical cable E and its terminal connector T1 may be completely removed from the reel 60 in the following manner. The electrical cable E is initially helically unwound from the drum portion 60*b*, such as by rotating the reel 60 in the direction indicated by the arrow 79 in FIG. 5 until only that portion of the cable conductor C extending under the gate member lower edge 72*a* outwardly from the reel drum 60*b* remains in contact therewith. At this point, if it is desired to employ the winch assembly 80 to control the movement of the electrical cable E from the supply reel assembly R to a remote location, the winch assembly protective connector 82 is threadably connected with the electrical cable terminal connector T1. Additionally, at this point, the trigger member 76 is moved to engage its protrusion 76*a* with the gate member 72 forcing it to the second inward position, as illustrated in FIGS. 5 and 5A. In the position illustrated, a portion of the electrical cable conductor C is disposed adjacent the reel end wall 60*c*. The cable E may then be moved upwardly between the gate member 72 and flange member 71 outwardly therefrom with simultaneous movement of the terminal connector T1 upwardly and outwardly from the grooved catch plate 73 thereby providing cable release from the reel 60. If desired, such release may be effected by holding the electrical cable E in a stationary position such as by braking the winch assembly 80 in a known manner and rotating the reel 60 in the direction indicated by the arrow 79 in FIG. 5. During reel rotation, the cable E is caused to pass between the gate member 72 and flange member 71 with simultaneous braking of contact between the terminal connector T1 and the grooved catch plate 73. During removal, either by moving the cable or by rotating the reel 60, the cable E contacts the trigger protrusion 76*a* and forces it from engagement with the gate member 72 permitting the gate member 72 to forcibly return under spring pressure from the inward second position to the first position in alignment with the reel end wall edge 60*e*, as illustrated in FIG. 3.

The apparatus of the present invention may be employed to supply, receive and store 9 sections of the above-described electrical cable for substantially any use. However, as disclosed in U.S. Pat. application Ser. No. 621,157 by Roy H. Cullen, Joshua M. Jackson and Jim Witovek, Jr., entitled "Electrical Cable Feeding And Removing Apparatus", filed Oct. 9, 1975, the apparatus of this invention may be used with the apparatus of said application, for positioning the entire length of one or more electrical cable sections in a well bore and removing same, as described in Unites States patent application Ser. No. 621,131 by Roy H. Cullen, Joshua M. Jackson, Jim Witovek, Jr. and Terry Jones, entitled "Method And Apparatus For Deployment And Retrieval Of Fixed Lengths Of Electrical Cable Into And From A Well Bore", also filed Oct. 9, 1975.

The foregoing disclosure and description of the invention are illustrative and explanatory thereof, and various changes in the size, shape and materials as well as in the details of the illustrated construction may be made without departing from the spirit of the invention.

We claim:

1. An apparatus for receiving, storing, and supplying a fixed length of an electrical cable section having substantially rigid terminal connectors at each end thereof, said apparatus comprising:

a reel adapted for rotation with a section of electrical cable being helically wound on or unwound from said reel; and releasable securing means for securing one of the electrical cable terminal connectors with the reel for rotation therewith while the cable is wound on or unwound from the reel and for releasing a secured connector from the reel to thereby release the entire length of the cable from the reel upon unwinding.

2. The apparatus of claim 1, wherein:

said reel includes a cylindrical drum having a pair of opposing cylindrical end walls, said end walls respectively having greater diameters then said cylindrical drum; and wherein said releasable securing means is mounted on one of said reel end walls.

3. The apparatus of claim 2, including:

means for releasably positioning at least one of the electrical cable terminal connectors outwardly adjacent an outer surface of said one reel end wall for rotation with the reel.

4. The apparatus of claim 3, wherein said connector positioning means includes:

an outwardly extending flange mounted with said reel end wall outer surface and forming a retainer space therebetween; and a catch member mounted between the flange and the reel end wall, said catch member having a groove for receiving the electrical cable conductor and adapted for engaging said cable connector with said electrical cable being wound onto or unwound from said reel.

5. The apparatus of claim 3, further including:

means for positioning the electrical cable conductor on the reel drum inwardly of said reel end wall with the cable connector positioned outwardly adjacent the end wall outer surface for winding the cable section conductor on said reel and for positioning said cable conductor outwardly of said reel end wall from the reel drum with said cable being unwound therefrom.

6. The apparatus of claim 5, wherein said cable conductor positioning means includes:

a gate member pivotally mounted with the reel end wall, said gate member having an arcuate-shaped lower edge spaced from the reel drum for passage of the electrical cable conductor under the gate member.

7. The apparatus of claim 6, wherein said gate member is adapted for pivotal movement between a first position in substantial alignment with an outer circumferential edge of the reel end wall and a second position inwardly relative to the reel end wall outer surface in relation with the reel drum.

8. The apparatus of claim 7, including:

means for moving said gate member to said inward second position to permit the electrical cable to pass under and outwardly of the gate member with the cable being unwound from the reel to release the entire length of cable from the reel.

9. The apparatus of claim 1, including:

means for transporting one end of the fixed length of continuous electrical cable between a remote location and said reel.

* * * * *